United States Patent [19]

Johnson et al.

[11] 3,966,078

[45] June 29, 1976

[54] TANK VENT

[75] Inventors: Leland L. Johnson, Edina; Lindley A. Parkinson, Anoka, both of Minn.

[73] Assignee: Brown-Minneapolis Tank & Fabricating Co., Minneapolis, Minn.

[22] Filed: Oct. 9, 1973

[21] Appl. No.: 404,282

[52] U.S. Cl. ..... 220/85 R; 220/209; 220/374

[51] Int. Cl.[2] ..... B65D 25/00; B65D 51/16

[58] Field of Search ..... 220/44 R, 44 A, 44 B, 220/44 C, 44 D, 44 E, 85 R, 86 R, 209, 373, 374

[56] References Cited

UNITED STATES PATENTS

| | | | |
|---|---|---|---|
| 670,794 | 3/1901 | Lott | 220/44 A |
| 2,492,225 | 12/1949 | Kester | 220/44 R |
| 2,665,091 | 1/1954 | Starck | 220/44 X |
| 2,679,333 | 5/1954 | Starck | 220/44 R X |
| 3,250,420 | 5/1966 | Kohn | 220/86 R X |
| 3,548,847 | 12/1970 | Roven | 220/44 R X |
| 3,672,533 | 6/1972 | McKean | 220/44 R |

*Primary Examiner*—Jerry W. Myracle
*Assistant Examiner*—Charles Corenstein
*Attorney, Agent, or Firm*—Burd, Braddock & Bartz

[57] ABSTRACT

A vent for a truck mounted tank comprising a duct, one end of which originates in the normal upper expansion space of the tank interior and terminates on the outside of the tank so that the duct can convey air from the interior of the tank to the outside atmosphere surrounding the tank. The duct is so designed that regardless of what position it is in, it has a generally upward or vertical component between the inlet and outlet portions of the duct, which provide that a portion of the duct is always above the level of the liquid in the tank, which prevents liquid from flowing through the duct from the interior of the tank to the outside atmosphere regardless of what position the tank is in. The duct preferably extends the full length of the tank and completely encircles the tank interior at least once. To prevent liquid from inadvertantly entering the duct, the duct may be provided with a low pressure check valve.

38 Claims, 4 Drawing Figures

TANK VENT

When liquid is added to or withdrawn from a closed container such as a tank, the container must be vented to allow air to flow into or out of the tank. Otherwise said filling or emptying cannot be completed either because of the back pressure of air trapped in the tank, which prevents complete filling, or the development of a vacuum which prevents the liquid from emptying.

It is also desirable to prevent the liquid from inadvertently escaping from the tank because of surging, tipping or overturning of the tank, expecially if the liquid is flammable or highly volatile, and such commonly occurs when the tank is mounted on a truck or over-the-road transport.

Various devices have been developed to solve this spillage problem, but none are completely successful, all are expensive and all are subject to malfunction and leakage because they involve working or moving parts, and in fact do leak to some extent in actual usage.

Thus, one object of this invention is to provide a vent for a tank which will prevent the formation of a vacuum in the tank when liquid is discharged therefrom and permits air to escape when liquid is being added thereto.

Another object is to provide a vent which will prevent liquid from leaking or spilling from the tank because of surging during movement, or because of listing or tilting of the tank.

Still another object is to provide a vent which will prevent liquid from escaping, regardless of what positions the tank is in, even if it is completely overturned or standing on end.

A further object is to provide a basic vent system which will prevent the formation of a vacuum and the development of internal air or vapor pressures, prevents spillage under any and all circumstances, and yet is simple and inexpensive to construct, is readily adaptable to all kinds of tanks, and will not malfunction in and of itself because it has no working or moving parts.

The invention relates to a new and novel method of and system for venting a tank, which system is extremely simple and inexpensive in design and construction, as compared with venting systems previously and presently available, and which also functions to prevent any liquid from escaping from the interior of the tank through the duct system in the event the tank is tipped or turned into some position other than normal.

The novel venting system of this invention prevents pressure or vacuum build-up when the tank is filled or emptied and also prevents liquid from escaping, all by means of a single system. In tanks presently available, two or more vents, or vents of complicated and expensive construction, are needed to accomplish what is accomplished by the single venting system of this invention. For example, vents that are currently on the market are commonly spring loaded and because of the static head that is encountered in an overturned tank, they are high pressure vents that open at 3 psi. This pressure is too high for normal venting so that a separate back pressure valve is required. Also, many of the available venting systems tend to malfunction due to such things as improperly tensioned springs, ball valves which fail to seat properly, etc.

These and other objects and advantages will be apparent from the following description set forth in conjunction with the drawings accompanying this description, which set forth and illustrate one mode of accomplishing this invention, it being understood that there are other modes and methods and structure available to accomplish the intent and methods and structure available to accomplish the intent and purpose of the invention.

In the drawings

Figure 3:
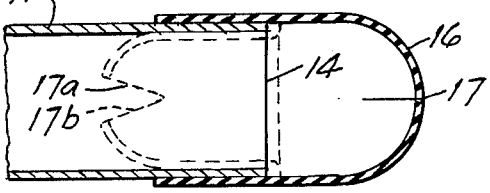
Figure 4:
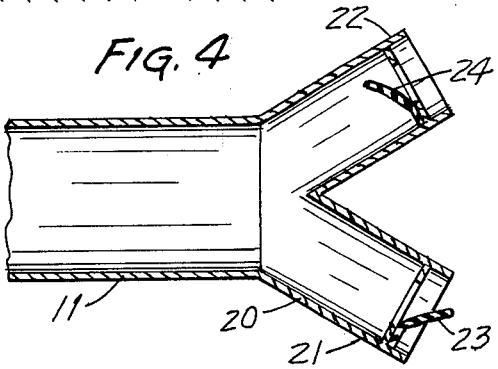

FIG. 3 is a partial longitudinal sectional view on an enlarged scale of a novel anti-splash valve forming part of this invention and used in conjunction with and as a part of the duct system which vents the tanks, the position of the valve under normal or low pressure conditions being shown in solid outline, the portion of the valve under high pressure conditions being shown in broken outline; and FIG. 4 is a schematic view of an alternate form of the invention.

Referring to the drawings for a more accurate description of this invention, the tank shell 10 is provided interiorially with an elongate duct or tube 11 which functions as the vent of this invention. In the illustrated form, the duct 11 is secured to and basically follows the interior profile of the tank and preferably winds around the tank interior in helical or spiral fashion as it extends the entire length of the tank. Most tanks, and particularly those used to transport liquids, have an expansion or outage space 12 above the liquid level when the tank is filled, which space 12 is defined by the liquid level line 13 which is shown as a broken line. The duct 11 is provided with an inner end portion 14 which communicates with said expansion space 12. The duct 11 is also provided with an outer end portion 15 which vents the interior air of the tank to the outside atmosphere, the outer portion 15 of the duct being connected to a fitting 20 which in turn is connected to and passes through the shell 10 of the tank to accomplish same.

Because the duct 11 extends the full length of the tank and winds about the entire periphery of the tank, and since these tanks are not filled entirely full, in any position which the tank assumes, including one end or overturned or tilted at an angle, some part of the vent duct 11 will be above the liquid surface and the liquid will not flow through it. If in some application or by inadvertance, the tank were initially completely filled with liquid, leakage would at best occur for only a short period of time until the liquid level receded to a point where a portion of the duct was above the surface of the remaining liquid within the interior of the tank, whereupon the leakage through the duct would automatically cease.

Under some circumstances, particularly where flamable or corrosive liquids are being carried, it is desirable to prevent splashing or surging liquid from entering the vent and ultimately finding its way out of the tank, and to prevent evaporation of a volatile product such as gasoline. To accomplish this, a two-way anti-splash valve or seal 16 is installed or mounted on the inner end portion 14 of the duct.

The anti-splash seal 16 which is illustrated comprises a nipple-shaped member of flexible material having a slit or slot 17 in the outer end thereof, which seal can be formed of any suitable flexible material such as rubber. The splash valve 16 is preferably formed in such a manner that the lips 17*a* and 17*b* of slot 17 will remain in contact with each other as in the solid line position of FIG. 3 and seal the interior of tube 11 from liquid in the tank. However, said lips 17*a* and 17*b* must be capable of separating, as seen in the broken line position of FIG. 3 and permitting air to pass therebetween and through the valve and tube when the tank is being filled or emptied. The solid line position of the valve in FIG. 3 illustrates the shape and condition of the valve under normal conditions where the pressure in the tank is the same as the pressure outside the tank, and also illustrates its shape and condition when the pressure is lower in the tank than outside, so that air is being admitted to the tank, such as when the tank is being emptied. It will be understood, of course, that when air is passing through the valve, the lips 17*a* and 17*b* are separated enough to permit air to pass therebetween, regardless of whether the valve is in the broken line or the solid line position of FIG. 3.

The broken line position of FIG. 3 illustrates the probable shape and condition of the valve 16 when the pressure in the tank is higher than outside (such as during filling of the tank), and air is being forced out of the tank through the tube 11 to the outside atmosphere. In this condition the valve has reversed itself and been drawn into the interior of the tube, where the lips of the slot 17 still preferably remain in sealing contact except when air is being forced therebetween and the lips are separated, as illustrated in the broken line position of FIG. 3. The valve will preferably reform itself to the solid line shape of FIG. 3 outside the tube 11 when filling stops. If it doesn't, the lips of slot 17 should at least remain in contact to seal the tube from splashing liquid.

The valve 16 functions as a two-way valve and also prevents any liquid, or foreign objects, from entering the tube. Thus, when the high pressure side of the system is on the interior of the tank, the air flows through the duct, pushing the seal inwardly and causing the lips of the slit to open to permit the interior air to escape until the pressures are equalized. When the interior of the tank is on the low pressure side of the system, the seal is drawn by the vacuum into the interior of the tank and outside the tube and assumes the solid line position illustrated in FIG. 3, the atmospheric air forcing the lips of the slit apart and entering the interior of the tank until the pressure becomes equalized on both sides of the seal. The duct is of substantially rigid formation, and the seal, being flexible can be readily slipped over and fitted on the outer end of the duct to seal the duct.

In one form of the invention the duct 11 can lie in substantially a common plane, such as encircling the tank once, with the inlet and outlet very close together, or the tube could be simply straight and extend longitudinally of the tank. However, the tube 11 is preferably of a spiral formation (as illustrated) so that the inlet and outlet portions of the duct are spaced longitudinally of one another with respect to the longitudinal axis of the tank. Thus, the duct is preferably spiraled from the front to the back of the tank (as illustrated) so that if the tank were to stand on end, or to assume a diagonal position diagonal to either the horizontal or vertical or both, the contents could not run out as some portion of the duct would be above the liquid level for any position of the tank, and thus prevent any leakage of liquid from the tank.

A drain valve 18 is provided at the lowest elevational portion of each loop of the duct 11 to enable any condensation of liquid which inadvertently finds its way into the duct to be periodically removed or drained from the duct. In an alternate form, or in a multi-compartment tank, these drains could be joined together with common tubing having a common drain valve to periodically drain off any condensation from the entire system at one time.

The tank usually also has a man hole or hatch 19 to provide access to the interior of the tank. Most of the vents and anit-spill devices presently available are mounted in and form a part of such a hatch.

If the tank has a series of compartents sealed off from one another, as is commonly the case, a vent system similar to that described and illustrated herein would be provided for each of the compartments.

Other forms of valves may be used with the vent system instead of or in conjunction with valve 16.

Figure 1:
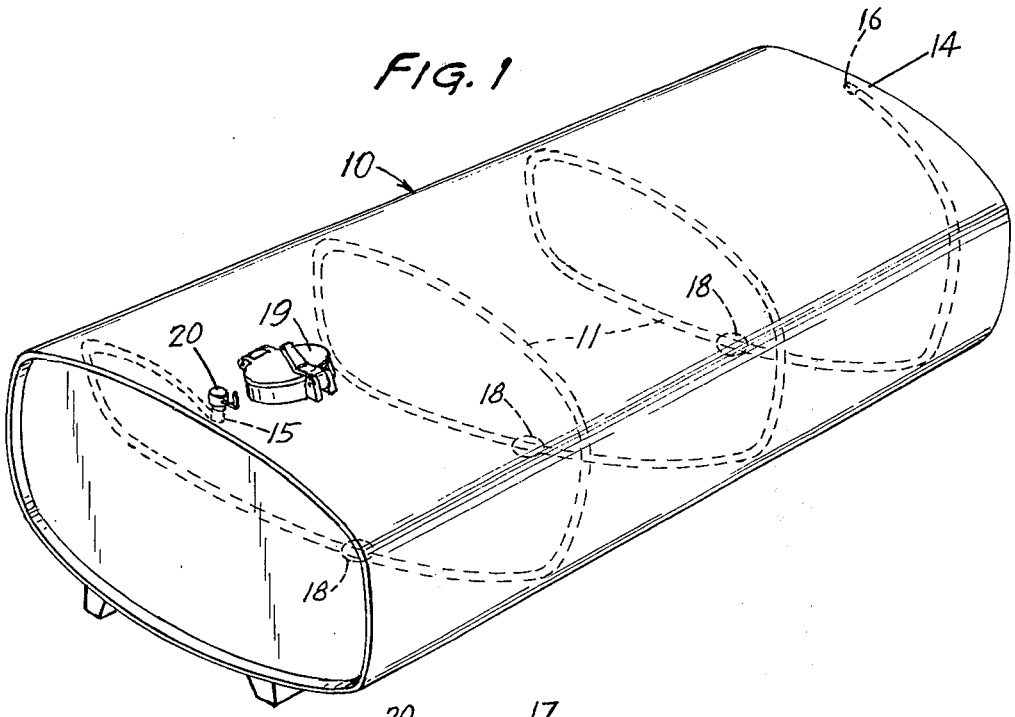
FIG. 1 is a perspective view of a tank embodying one venting system of this invention.
Figure 2:
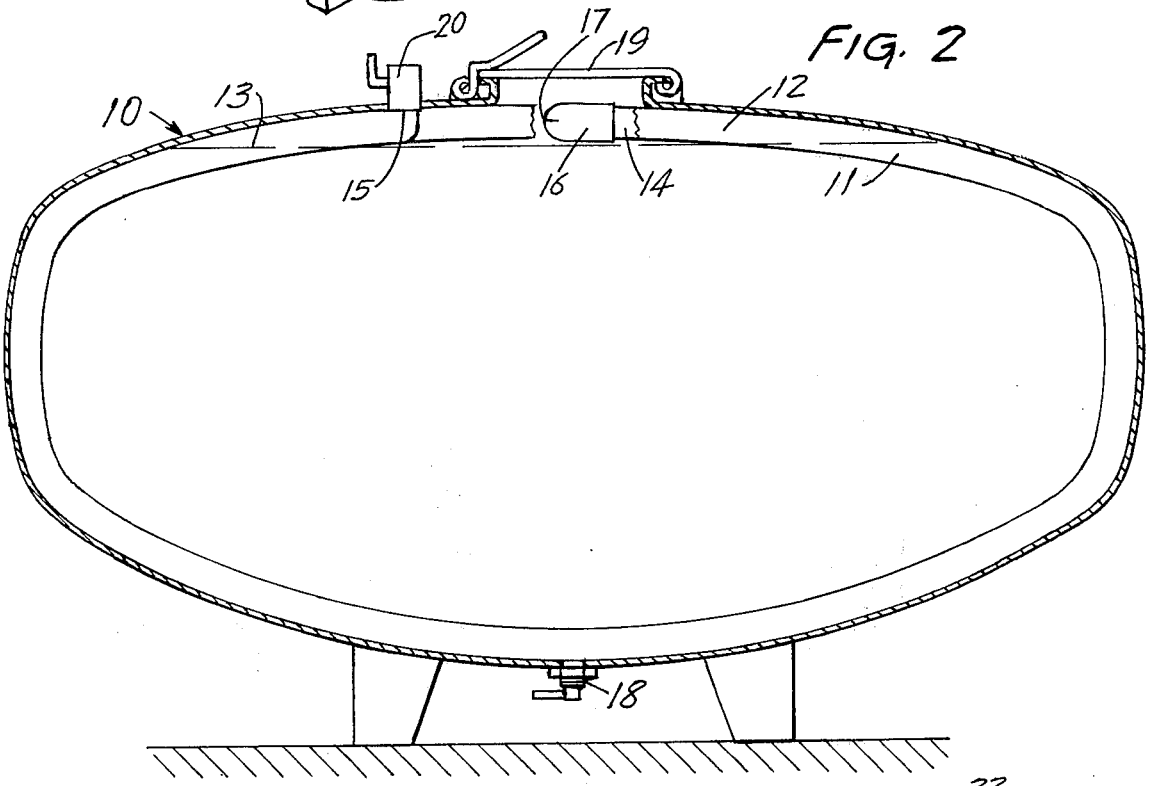
FIG. 2 is a cross sectional view thereof, with portions of the duct broken away.

For example, referring to FIG. 4, a Y-shaped duct inner portion is shown which could be used in place of the inlet 14 and valve 16 illustrated in FIG. 1–3 and previously described, having a pair of end portions 21 and 22 respectively. In one of these end portion 21 is installed a one-way check valve 23 that would open at a fraction of a pound per square inch and would function only to let air into the tank. A second check valve 24 would then be installed in the other end portion 22 that would also open at a fraction of a pound per square inch and would only function to let air out of the tank.

Since there is no static head to cause leakage through the vent tube, valves 23 and 24 can be back pressure valves with a light spring pressure of around ¼ p.s.i. can be used to prevent splashed liquid from entering the vent tube and to prevent evaporation.

It is also within the scope of this invention to use a single two-way check valve, or an anti-splash valve such as 16 in conjunction with conventional check valves such as 23 and 24.

If regulations prevent venting certain kinds of liquid such as gasoline to the atmosphere, it is within the scope of this invention to provide collection devices for the vented air.

It will thus be appreciated that in its simplest form, this invention comprises a single length of tubing which follows the interior configuration or profile of the tank and has an inner end which communicates with the normal air expansion area of the tank and has an outer end portion which pierces and goes through the tank shell and which terminates in an outlet opening of some form which communicates with the atmosphere so that the tank interior can be vented directly to the outside atmosphere. It will be appreciated that this is an extremely simple and straightforward method of venting the tank which requires a minimal amount of material and installation effort and in its simplest form requires no working parts. The tank is continuously vented and yet if it is turned to a position other than normal, there is absolutely no leakage through the duct if there is any expansion area at all, and even if there is no air at all originally in the tank, any leakage due to change in position of the tank will be minimal because as soon as a portion of the liquid is removed, an air space is automatically provided and with the formation of this air space, the venting duct automatically has a portion thereof disposed above the liquid level so that liquid cannot flow therethrough from the interior of the tank to the outlet end of the duct.

To prevent vandals from stuffing foreign objects into the tube which might plug it up, or to prevent foreign objects from accidentally falling into the tube, and to prevent rain from falling into the tube and thereby plugging it up and causing it to malfunction, the fitting 20 to which the outer end 15 of the duct is attached may be a valve as illustrated, or may take the form of some other type of protective device, such as a cap, seal or baffle.

It will be understood that when reference is made herein to the "atmosphere", that reference is being made to any of the atmosphere outside of the tank itself, regardless of whether it constitutes "all out doors" so to speak, or whether it constitutes another air space which is itself enclosed and possibly in communication with the general out-of-doors or outside atmosphere.

Thus, it is anticipated that in the future, regulations or laws may, for safety or ecological reasons, prohibit venting certain type of liquids, such as gasoline, directly to the outside atmosphere, in which case means would be provided for collecting the vented air such as by means of additional piping.

Although the invention heretofar has been described for use in conjunction with a truck mounted tank as one desirable application thereof, it will be understood that the vent system of this invention is usable in any enclosed chamber which may require venting, particularly those which contain a liquid and for whatever reason are subject to tipping, repositioning or turnover while partially or completely filled.

The duct is preferably of a diameter or cross sectional size which is smaller than, or at least no larger than, the air space or outage space within the tank. This will assure that some part of the duct will always be completely above the liquid, regardless of what position the tank assumes, if the duct is oriented to assure that part of its longitudinal extent will always be at the top of the tank regardless of the tanks position. The inner end 14 of the duct preferably is located so that it will normally communicate directly with the air space when the tank or other enclosed chamber is in its normal operative position. This will help prevent liquid from entering the duct under normal conditions.

One of the preferred ways to assure that some part of the duct will always be at the top of the tank and in the air space, regardless of the tanks attitude or position, is to mount the duct so that it extends from one end of the tank to the other, and in the course of that extent follows the configuration of tank so as to completely encircle or assume the configuration or annulus of the cross-sectional profile shape of the tank at least once.

Although one preferred location of the outer end of the duct is at the normal top of the tank, as illustrated, there is more flexibility in locating the outer end 15 than the inner end 14 of the duct. The outer end can be located virtually anywhere that is convenient and effective in so far as actual venting is concerned, since the contents of the tank have no access thereto.

In the illustrated version, the tank is elongated, with the venting duct extending in the direction of greatest longitudinal dimension and spiraling about the cross-sectional dimension which is at right angles to that longest dimension. However, the principle of the invention can be applied to any shape of container, whether symmetrical or unsymmetrical. The vent can extend in the direction of any dimension, whether the longest or the shortest or in between, or where all the dimensions are the same. In the most prefered form of the invention, however, the duct spans every dimension, to help assure that some part of the duct will always be above the liquid level. If the movement of the container is limited, then the dimensional extension of the duct can be limited. Thus, for example, if the illustrated tank could only turn or roll about its longest axis, and could never be completely or partially tilted on end, then it would not be necessary to have the vent extend the full length of the tank, as illustrated. In such a situation, it would suffice if the duct simply made substantially complete encirclement of the cross-sectional dimension and lay in a substantially common plane from one end of the duct to the other. Thus, the duct could assume the coiled appearance of FIG. 2, assuming that the duct all lay in a cross-sectional plane, and didn't extend longitudinally, as shown. Thus, the primary purpose of the invention is served if the duct is so oriented with respect to the possible or probable movements of the container that some part of the duct is always located in the interior air space. When the container can move in almost any direction, then the duct is preferably so oriented that some portion of it is generally horizontal and some portion of it is generally vertical, regardless of what position or attitude the tank assumes.

As previously indicated herein before, the venting system of this invention will not allow the escape of liquid from the tank under normal pressure conditions within the tank, regardless of what position the tank assumes. However, since it is intended that it serve as the sole vent for the tank, it is necessary that the vent also enable some escape if there is an abnormally high pressure build-up in the tank, such as may occur with highly volatile or flammable liquids, where the pressure builds up to an amount in excess of the static head pressure. Under such circumstances, liquid will escape through the vent until such time as the interior pressure is reduced to the static head pessure. Permitting escape of liquid under these conditions avoids the possibility of the tank and its contents exploding and thereby causing serious harm to persons and property.

It will, of course, be understood that various modifications, variations and changes may be made in the form, details, arrangements and proportion of the parts as set forth herein without departing from the spirit and scope of the invention, the specific embodiments described herein being given by way of example only for clearness of understanding, and no unnecessary limitations should be understood therefrom, and the appended claims should be construed as broadly as permissible in view of the prior art.

What is claimed is:

1. A vent for an enclosed chamber such as a tank, having wall structure defining said chamber, said vent comprising an elongated duct, said duct having a first end portion which communicates with the interior of such chamber, said duct having a second end portion in communication with the atmosphere surrounding said chamber, a portion of said duct within said chamber being generally horizontal and a portion of said duct being generally vertical regardless of what position the chamber assumes, and a normally closed two-way valve operatively connected to said first end portion.

2. The vent of claim 1 wherein at least one end portion of said duct is provided with a flexible seal having a normally closed slot formed therein for the passage of air therethrough.

3. The vent of claim 1, wherein said chamber has a maximum length dimension, a maximum width dimension, and a maximum height dimension, and wherein said duct substantially completely spans at least two of said dimensions, at least one of which is the vertical dimension.

4. The vent of claim 1, wherein said duct follows the profile of the interior wall of said structure so as to have substantially the same configurations as the vertical cross sectional configuration of the interior of the chamber.

5. The vent of claim 1, wherein said chamber has a normal operational position, and wherein said first end portion includes opening means contiguous with the highest part of the chamber when in said normal operational position whereby venting of the tank will take place at substantially all times when said chamber is in said position and there is any air space in the tank, regardless of the liquid level in the tanks.

6. The vent of claim 1 wherein said first end portion communicates with the interior of said chamber through a single opening in said duct.

7. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, said first end portion consisting of two openings, a normally closed first one way valve operatively connected to the first end portion to control the flow of air through one opening, a normally closed second one way valve operatively connected to the first end portion to control the flow of air through the other opening, said first and second valves opening in opposite directions.

8. A vent for an enclosed chamber such as a tank, having wall structure defining said chamber, said vent comprising: an elongate duct, said duct having a first end portion which communicates with the interior of said chamber, said duct having a second end portion in communication with the atmosphere surrounding said chamber, a tubular seal member formed of flexible material and having a closed end operatively connected with at least one end portion of said duct; said end having a normally closed slot therein for admitting air to and discharging air from said duct, said seal member, when said slot is closed, preventing liquid from entering said duct.

9. A vent for an enclosed chamber such as a tank, having wall structure defining said chamber, said vent comprising an elongate duct, said duct having a first end portion which communicates with the interior of said chamber, said duct having a second end portion in communication with the atmosphere surrounding said chamber, and wherein said wall structure is a truck mounted tank having front and back end portions and annular wall structure connecting said end portions, one end portion of said duct being adjacent one end portion of said tank, the other end portion of said duct being adjacent the other end portion of said tank, said duct being disposed in spiral fashion about the tank interior along its length from said first to said second end portion.

10. A vent for an enclosed chamber such as a tank, having wall structure defining said chamber, said tank comprising an elongate duct, said duct having a first end portion which communicates with the interior of said chamber, said duct having a second end portion in communication with the atmosphere surrounding said chamber, and wherein said duct when installed in said chamber has a normal operative position, and wherein said duct in said normally operative position has a lowermost portion, and drain means provided at said lowermost portion, said drain means extending through the wall of said structure for draining said duct.

11. A vent for an enclosed chamber such as a tank, said chamber having a wall structure defining said chamber, said chamber having a predetermined normal generally horizontal operational position, said wall structure including a top wall and a bottom wall when said chamber is in said position, said duct having a first end portion which communicates with the interior of said chamber adjacent said top wall, said duct extended between said top wall and bottom wall and having at least a portion thereof lying in a generally vertical plane when said chamber is in said normal horizontal position, means for locating the first end portion of said duct adjacent said top wall whereby said duct does not have any communication with the interior of said chamber other than in an area adjacent said top wall when said chamber is in normal horizontal position, said duct having a second end portion in communication with the atmosphere surrounding said chamber.

12. The vent of claim 11 wherein said duct forms a generally annular configuration when said chamber is viewed in normal vertical cross section.

13. The vent of claim 11, wherein said duct forms a generally annular configuration when said chamber is viewed in normal vertical cross section, said duct being adjacent said wall structure throughout the major portion of its length.

14. The vent of claim 11 including: means rigidly securing said duct to the wall structure defining said chamber whereby said duct moves simultaneously with the movement of said chamber.

15. The vent of claim 11, wherein said second end portion leaves the interior of said chamber through an opening in said top wall of said chamber.

16. The vent of claim 11, wherein said chamber has a maximum length dimension, a maximum width dimension, and a maximum height dimension, and therein said duct substantially completely spans at least two of said dimensions.

17. The vent of claim 11, wherein said chamber has a maximum length dimension, a maximum width dimension, and a maximum height dimension, and therein said duct substantially completely spans at least two of said dimensions.

18. The vent of claim 11, wherein said duct follows the profile of the interior wall of said structure so as to have substantially the same configurations as a cross sectional configuration of the interior of the chamber.

19. The vent of claim 11, wherein the longitudinal extent of said duct forms the shape of a substantially complete annulus.

20. The vent of claim 11, wherein said end portions lie in a substantially common horizontal plane, and the length of said duct between said end portions from the shape of a substantially complete annulus, said duct being in close proximity to the inner face of said wall structure throughout substantially the entire length of the duct.

21. The vent of claim 11, wherein the duct is arranged in spiral fashion in a direction corresponding to a horizontal dimensional axis of said chamber, with said first and second ends of said duct being disposed in spaced relationship with respect to said axis of said chamber.

22. The vent of claim 11 including valve means associatd with said duct which permits air, when the air pressure on opposite sides of said valve is unequal, to pass through said duct located inside said chamber and responsive to air pressure but which will prevent any liquid from passing from the interior of the chamber into said duct when said valve means is closed.

23. The vent of claim 11 including: means making said duct immovable with respect to said wall structure throughout substantially the entire length of said duct.

24. The vent of claim 11, wherein at least one end portion of said duct is provided with a flexible seal having a normally closed slot formed therein for the passage of air therethrough.

25. The vent of claim 11, wherein said chamber has normally upper and a normally lower portion, said duct comprising an elongate tubular member, said tubular member comprising a first end portion located adjacent the upper inner face of the wall porton of said structure defining the chamber to be vented and communicating with the interior of said chamber, said tubular member having a second end portion adapted to vent air to the atmosphere surrounding said chamber, there being no other openings in said duct between said end portions which communicates with the interior of the chamber, said second end portion communicating with said atmosphere through an opening in the wall structure defining the normally upper portion of said chamber, the length of said duct forming a substantially complete annulus approximating in size and shape a cross sectional profile of said chamber.

26. The vent of claim 11, wherein a portion of said duct within said chamber is generally horizontal and a portion of said duct is generally vertical regardless of what position the chamber assumes.

27. The vent of claim 11, wherein said first end portion is provided with a normally closed two way valve.

28. The vent of claim 11, wherein said first end portion consists of two openings, each of said openings being provided with a normally closed one way valve, said valves opening in opposite directions in direct communication with the interior of said chamber.

29. The vent of claim 11, wherein at least one end portion of said duct is provided with a tubular seal member formed of flexible material and having a closed end; said end having a normally closed slot therein for admitting air to and discharging air from said duct, said seal member, when said slot is closed, preventing liquid from entering said duct.

30. A vent for an enclosed chamber such as a tank, having wall structure defining said chamber, said vent comprising: an elongated duct, said duct having a first end portion with communicates with the interior of said chamber, said duct having a second end portion in communication with the atmosphere surrounding said chamber, said chamber having a normal operational position, said duct forming a generally annular configuration when said chamber is viewed in vertical cross section when in said position, wherein said chamber has a normally upper interior portion when in said position and wherein both end portions of said duct are located in said upper portion, and at least a portion of said duct lies in a generally horizontal plane in said upper portion, and wherein the duct is arranged with respect to the configuration of the chamber whereby when there is liquid in the chamber, and there is also an air space within the chamber of a height corresponding to the diameter of the duct, then the liquid level will be below some part of the duct so that at least a complete cross sectional portion of the duct interior is above said liquid level, and wherein said duct follows the profile of the interior wall of said structure, said duct being in fixed relationship to said wall structure throughout the majority of the length of the duct, said second end portion communicating with said atomsphere through an opening in the wall structure defining the normally upper portion of said chamber, the length of said duct forming a substantially complete annulus approximating in size and shape a cross sectional profile of said chamber.

31. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, said end portions lying in a substantially common horizontal plane, and the length of said duct forms the shape of a substantially complete annulus, between said end portions, said duct being in close proximity to the inner face of said wall structure throughout substantially its entire length, there being no communication with the interior of the tank between said end portions.

32. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, a portion of said duct being generally vertical regardless of what position the chamber assumes, valve means within said chamber operatively connected to the duct to allow air to pass through said duct but which will prevent any liquid from passing from the interior of the chamber into said duct when said valve means is closed, said valve means opening and closing in response to difference between the air pressure in the chamber and the atmospheric pressure outside the chamber.

33. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, said chamber having a normally upper and a normally lower portion, said duct comprising an elongate tubular member, said tubular member comprising a first end portion located adjacent the upper inner face of the wall portion of said structure defining the chamber to be vented and communicating with the interior of said chamber, said tubular member having a second end portion adapted to vent air to the atmosphere surrounding said chamber, said second end portion communicating with said atmosphere through an opening in the wall structure defining the normally upper portion of said chamber, the length of said duct forming a substantially complete annulus approximating in size and shape a cross sectional profile of said chamber, when the chamber is viewed in vertical cross section.

34. A vent for an enclosed chamber such as a tank, having wall structure defining said chamber, said vent comprising: an elongate duct, said duct having a first end portion which communicates with the interior of said chamber, said duct having a second end portion in communication with the atmosphere surrounding said chamber, the first and second end portions of said duct lying in substantially the same horizontal plane when said chamber is in normal operative position, said duct forming the general configuration of an annulus between said first and second end portions, there being no intermediate openings to the interior of the chamber from said duct in the area between said end portions.

35. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, said chamber having a maximum length dimension, a maximum width dimension, and a maximum height dimension, and wherein said duct substantially completely spans at least two of said dimensions at least one of which is the vertical dimension, and wherein said duct follows the profile of the interior wall of said structure so as to have substantially the same configurations as the vertical cross sectional configuration of the interior of the chamber, and wherein the elongate configuration of the duct is such that if there is an air space in the chamber, regardless of what position the chamber is in, a portion of the length of said duct will be disposed above the level of any liquid in the chamber and thereby prevent liquid from passing through said duct, and wherein said end portions lie in a substantially common horizontal plane, and the length of said duct forms the shape of a substantially complete annulus, between said end portions, said duct being in close proximity to the inner face of said wall structure throughout substantially its entire length, there being no communication with the interior of the tank between said end portions.

36. A vent for an enclosed chamber such as tank, having wall structure defining said chamber, said vent comprising: an elongated duct, said duct having a first end portion which communicates with the interior of said chamber, said duct having a second end portion in communication with the atmosphere surrounding said chamber, said first end portion communicating with the interior of said chamber through a single opening in said duct, said single opening being provided with a flexible valve member having a normally closed slot therein, said valve member constituting the only moving parts for controlling the passage of liquid and gas through said opening.

37. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, a portion of said duct within said chamber being generally horizontal and a portion of said duct being generally vertical regardless of what position the chamber assumes, normally closed valve means cooperating with said first end portion to control the flow of fluid from the interior of said chamber into said duct, said valve means being adapted to open and close in response to differences in air pressure on opposite sides of said valve means, liquid being unable to pass from the chamber interior into said duct when said valve means is closed, said valve means remaining closed when the liquid level changes except during those periods when it opens because of differences in air pressure on opposite sides thereof.

38. A vent for an enclosed chamber such as a tank, having wall structure defining said chamber, said vent comprising: an elongated duct, said duct having a first end portion which communicates with the interior of said chamber, said duct having a second end portion in communication with the atmosphere surrounding said chamber, valve means cooperating with said first end portion to control the flow of fluid from the interior of said chamber into said duct, said valve means adapted to open in response to differences in air pressure on opposite side thereof, and to close when the air pressure on opposite sides is substantially equalized at some predetermined level, said valve means being within the interior of the chamber and exposed to the liquid contents thereof.

* * * * *

UNITED STATES PATENT AND TRADEMARK OFFICE

CERTIFICATE OF CORRECTION

PATENT NO. : 3,966,078

DATED : June 29, 1976

INVENTOR(S) : Leland L. Johnson et al

It is certified that error appears in the above-identified patent and that said Letters Patent are hereby corrected as shown below:

Column 1, line 15, "or" should be --for--.

Column 2, lines 4 and 5, after "intent", delete "and methods and structure available to accomplish the intent".

Column 4, line 1, "of" should be --or--.

Column 4, line 12, "compartents" should be --compartments--.

Column 4, line 57, after "any", insert --air--.

Column 5, line 67, "prefered" should be --preferred--.

Column 6, Claim 1, line 5, "such" should be --said--.

Column 8, Claim 16, line 5, "two" should be --one--.

Column 8, Claim 20, line 3, "from" should be --forms--.

Column 9, Claim 22, line 2, "associatd" should be --associated--.

Column 9, Claim 30, line 4, "with" (first occurrence) should be --which--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*